US010565943B2

(12) United States Patent
Xing et al.

(10) Patent No.: US 10,565,943 B2
(45) Date of Patent: Feb. 18, 2020

(54) DEVICE AND METHOD FOR REDUCING POWER CONSUMPTION OF LIQUID CRYSTAL DISPLAY, AND LIQUID CRYSTAL DISPLAY

(71) Applicant: WUHAN CHINA STAR OPTOELECTRONICS TECHNOLOGY CO., LTD, Wuhan, Hubei (CN)

(72) Inventors: Zhenzhou Xing, Hubei (CN); Qingcheng Zuo, Hubei (CN)

(73) Assignee: Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 157 days.

(21) Appl. No.: 15/563,238

(22) PCT Filed: Jul. 17, 2017

(86) PCT No.: PCT/CN2017/093220
§ 371 (c)(1),
(2) Date: Sep. 29, 2017

(87) PCT Pub. No.: WO2019/000505
PCT Pub. Date: Jan. 3, 2019

(65) Prior Publication Data

US 2018/0374433 A1 Dec. 27, 2018

(30) Foreign Application Priority Data

Jun. 27, 2017 (CN) ..... 2017 1 0511363

(51) Int. Cl.
*G09G 3/36* (2006.01)

(52) U.S. Cl.
CPC ... *G09G 3/3607* (2013.01); *G09G 2320/0626* (2013.01); *G09G 2320/0666* (2013.01); *G09G 2330/023* (2013.01)

(58) Field of Classification Search
None
See application file for complete search history.

(56) References Cited

U.S. PATENT DOCUMENTS

2017/0263195 A1* 9/2017 Itoi ..... G09G 3/3426
2017/0329399 A1* 11/2017 Azam ..... G06F 3/013
(Continued)

FOREIGN PATENT DOCUMENTS

CN 101385071 A 3/2009
CN 101676982 A 3/2010
(Continued)

*Primary Examiner* — Benjamin C Lee
*Assistant Examiner* — Emily J Frank
(74) *Attorney, Agent, or Firm* — Mintz Levin Cohn Ferris Glovsky and Popeo, P.C.; Steven M. Jensen

(57) ABSTRACT

The present disclosure provides a device for reducing power consumption of a liquid crystal display, which includes: a screen area acquisition module for acquiring a first screen area being viewed and a second screen area not being viewed while a viewer watches a screen of the liquid crystal display; and a dynamic backlight control module for performing a dynamic backlight control adjustment on the second screen area. The present disclosure also discloses a method for reducing power consumption of the power consumption reduction device and a liquid crystal display having device. The present disclosure realizes intelligently partitioning dynamic backlight control to the screen of the liquid crystal display and also reduces the power consumption.

5 Claims, 3 Drawing Sheets

(56) References Cited

U.S. PATENT DOCUMENTS

| | | | | |
|---|---|---|---|---|
| 2018/0096660 | A1* | 4/2018 | Liu | G09G 3/2003 |
| 2018/0188803 | A1* | 7/2018 | Sharma | G06F 3/013 |

FOREIGN PATENT DOCUMENTS

| | | | |
|---|---|---|---|
| CN | 103035209 | A | 4/2013 |
| CN | 104484043 | A | 4/2015 |
| CN | 106531073 | A | 3/2017 |
| CN | 106531123 | A | 3/2017 |
| JP | 2013-037076 | A | 2/2013 |

* cited by examiner

DEVICE AND METHOD FOR REDUCING POWER CONSUMPTION OF LIQUID CRYSTAL DISPLAY, AND LIQUID CRYSTAL DISPLAY

CROSS REFERENCE TO RELATED APPLICATION

This application is a national stage entry, filed under 35 U.S.C. § 371, of International Application No. PCT/CN2017/093220, filed on Jul. 17, 2017, which claims benefit of and priority to Chinese Patent Application No. N 201710511363.5, filed on Jun. 27, 2017, the entire contents of which applications are incorporated herein by reference.

TECHNICAL FIELD

The present disclosure belongs to the technical field of a liquid crystal display, and in particular, relates to a device and a method for reducing power consumption reduction of a liquid crystal display, and a liquid crystal display.

BACKGROUND ART

With the development of photoelectric and semiconductor technologies, it also promotes the rapid development of a flat panel display (FPD). Among various flat panel displays, a liquid crystal display (LCD) has been applied to all aspects of life since it has many advantages, such as high space utilization efficiency, low power consumption, zero radiation, low electromagnetic interference and so on.

In an LCD, a backlight has a power consumption occupying 70% to 80% of the total power consumption of the LCD. As the intelligent terminal gets thinner and thinner, a capacity of built-in batteries thereof also gets smaller and smaller, and thus how to make the intelligent terminal to save more power becomes a consistent goal in the industry.

Content Adaptive Backlight Control (CABC) is a technique for adjusting backlight brightness to save backlight power consumption, and its principle is to detect an average brightness of a picture displayed on a liquid crystal display, to adaptively reduce the backlight brightness of the liquid crystal display based on the detected average brightness, and meanwhile to increase a grayscale value of the picture displayed on the liquid crystal display, thereby compensating the displayed picture the brightness of reduced due to the decreasing of the backlight brightness.

However, in the prior art, a content adaptive backlight control adjustment is performed on the backlight corresponding to the whole screen of the liquid crystal display, but it is impossible to perform the content adaptive backlight control adjustment on a specific area, for example, a screen area not viewed by the viewer.

SUMMARY

In order to solve the above problem existing in the prior arts, an object of the present disclosure is to provide a device and a method for reducing power consumption reduction of a liquid crystal display for implementing intelligently partitioning dynamic backlight control, and a liquid crystal display.

According to an aspect of the present disclosure, a device for reducing power consumption of a liquid crystal display is provided, which includes a screen area acquisition module for acquiring a first screen area being viewed and a second screen area not being viewed while a viewer watches a screen of the liquid crystal display, and a dynamic backlight control module for performing a dynamic backlight control adjustment on the second screen area.

Furthermore, the screen area acquisition module includes a view locating unit for acquiring a viewing angle of eyes of the viewer while the viewer watches the screen of the liquid crystal display, a processing unit for determining the first screen area being viewed based on the acquired viewing angle of eyes of the viewer, and a first calculating unit for subtracting the first screen area by the screen of the liquid crystal display to calculate the second screen area.

Furthermore, the dynamic backlight control module includes a receiving unit for receiving externally input image data, a characteristic parameter extraction unit for extracting a characteristic parameter of the image data corresponding to the second screen area in the image data, a second calculating unit for calculating a backlight adjustment factor based on the extracted characteristic parameter, a backlight adjustment unit for adjusting brightness of the backlight corresponding to the second screen area based on the backlight adjustment factor, and a grayscale value compensation unit for compensating a grayscale value of pixels corresponding to the second screen area based on the backlight adjustment factor.

According to another aspect of the present disclosure, a liquid crystal display including the above device is provided.

According to yet another aspect of the present disclosure, a method for reducing power consumption of the liquid crystal display is provided, which includes acquiring a first screen area being viewed and a second screen area not being viewed while a viewer watches a screen of the liquid crystal display, and performing a dynamic backlight control adjustment on the second screen area.

Further, the acquiring of the first screen area being viewed and the second screen area not being viewed while the viewer watches the screen of the liquid crystal display specifically includes acquiring a viewing angle of eyes of the viewer while the viewer watches the screen of the liquid crystal display, determining the first screen area being viewed based on the acquired viewing angle of eyes of the viewer, and subtracting the first screen area by the screen of the liquid crystal display to obtain the second screen area.

Further, the performing of the dynamic backlight control adjustment on the second screen area specifically includes receiving externally input image data, extracting a characteristic parameter of the image data corresponding to the second screen area in the image data, calculating a backlight adjustment factor based on the extracted characteristic parameter, adjusting brightness of the backlight corresponding to the second screen area based on the backlight adjustment factor, and compensating a grayscale value of pixels corresponding to the second screen area based on the backlight adjustment factor.

The present disclosure has such an advantageous effect that the device and method for reducing power consumption of the liquid crystal display realizes intelligently partitioning dynamic backlight control to the screen of the liquid crystal display and also reduces the power consumption.

BRIEF DESCRIPTION OF THE DRAWINGS

These and other aspects, features and advantages of embodiments of the present disclosure will become more apparent from the following description of the embodiments, taken in conjunction with the accompanying drawings in which.

DETAILED DESCRIPTION OF EXEMPLARY EMBODIMENTS

Embodiments of the present disclosure will be described in detail below by referring to the accompanying drawings. However, the present disclosure can be implemented in many different forms, and should not be construed to be limited to detailed description set forth herein. Instead, these embodiments are provided for explaining the principle and actual application of the present disclosure, so that other skilled in the art can understand various embodiments and amendments which are suitable for specific intended applications of the present disclosure.

Figure 1:
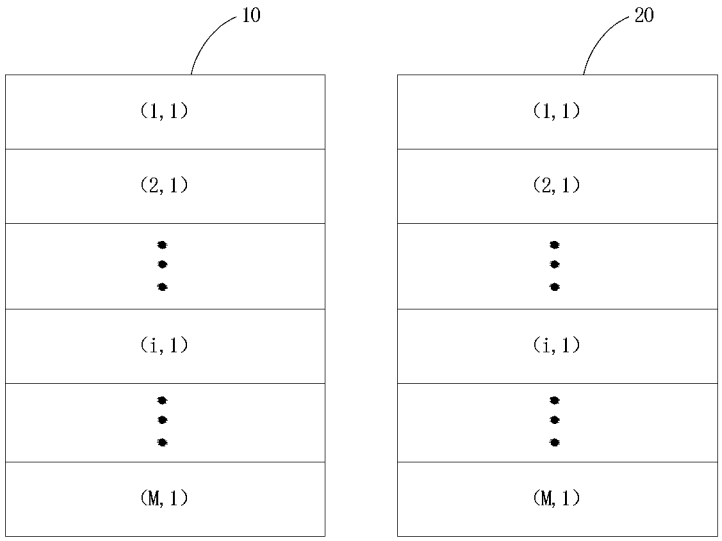
FIG. 1 is a schematic view of region partition of a liquid crystal panel and a backlight module according to an embodiment of the present disclosure.

FIG. 1 is a schematic view of region partition of a liquid crystal panel and a backlight module according to an embodiment of the present disclosure. In FIG. 1, a left portion represents a region partition view of the liquid crystal panel, and a right portion represents a region partition view of the backlight module.

Referring to FIG. 1, a liquid crystal panel 10 is partitioned into M×1 rectangular panel partitions (1, 1), . . . (M, 1) in a column direction, and a backlight module 20 is partitioned into M×1 rectangular backlight partitions (1, 1), . . . (M, 1) in the column direction, wherein a rectangular panel partition (i, 1) corresponds to a rectangular backlight partition (i, 1), and $1 \leq i \leq M$.

Here, only one region partition method of the liquid crystal panel 10 and the backlight module 20 is illustrated, but the present disclosure is not limited hereto. For example, the liquid crystal panel 10 and the backlight module 20 can be divided into 1×N partitions in a row direction, wherein a rectangular panel partition (1, j) corresponds to a rectangular backlight partition (1, j), and $1 \leq j \leq N$; or the liquid crystal panel 10 and the backlight module 20 can be divided into M×N partitions in column and row directions by array dividing, wherein a rectangular panel partition (i, j) corresponds to a rectangular backlight partition (i, j), and $1 \leq i \leq M$ and $1 \leq j \leq N$.

Figure 2:
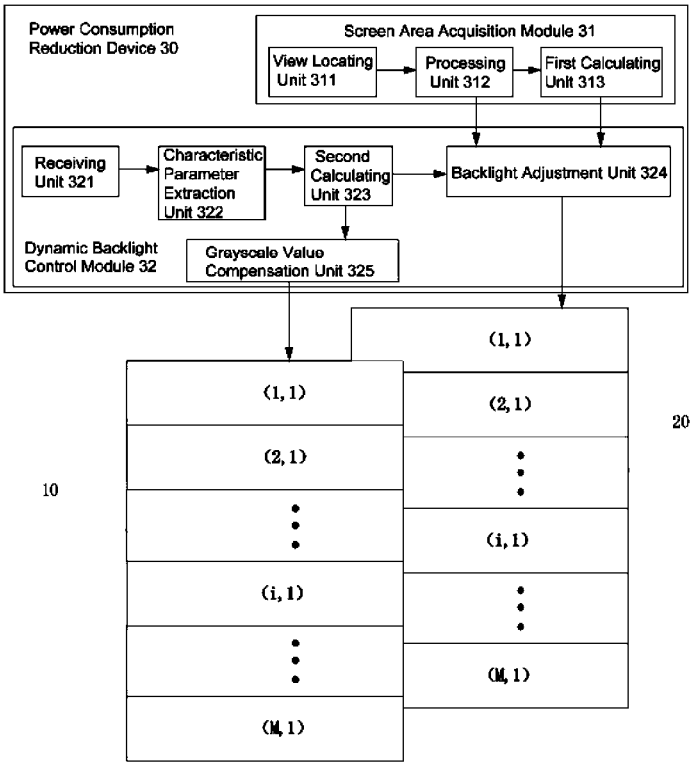
FIG. 2 is a schematic structural view of a liquid crystal display according to an embodiment of the present disclosure.

FIG. 2 is a schematic structural view of a liquid crystal display according to an embodiment of the present disclosure.

Referring to FIG. 2, the liquid crystal display according to an embodiment of the present disclosure includes a liquid crystal panel 10, a backlight module 20 and a power consumption reduction device 30.

In particular, when a viewer watches a screen of the liquid crystal display, he/she cannot watch the whole screen, but only can watch a partial screen area of the whole screen due to limitation of viewing angle of eyes. In this case, a backlight dynamic adjustment is performed on a screen area not being viewed by the eyes of the viewer rather than the screen area being viewed by the eyes of the viewer, which can dynamically adjust and control the backlight of the screen more intelligently and can reduce power consumption as well. The specific description is presented as follows.

The power consumption reduction device 30 includes a screen area acquisition module 31 and a dynamic backlight control module 32.

The screen area acquisition module 31 is configured to acquire a first screen area 11 being viewed by the viewer and a second screen area 12 not being viewed by the viewer while the viewer watches a screen of the liquid crystal display. The dynamic backlight control module 32 is configured to perform a dynamic backlight control adjustment only on the second screen area 12, but not to perform the dynamic backlight control adjustment on the first screen area 11.

Referring to FIG. 2 again, the screen area acquisition module 31 includes a view locating unit 311, a processing unit 312 and a first calculating unit 313.

The view locating unit 311 is configured to acquire a viewing angle of eyes of the viewer (also referred to as "viewing angle of the viewer") while the viewer watches the screen of the liquid crystal display. In the present embodiment, the view locating unit 311 can include a camera and a biosensor, and can acquire the viewing angle of eyes while the viewer watches the liquid crystal display through the camera and the biosensor, but the present disclosure is not limited hereto.

The processing unit 312 is configured to determine the first screen area 11 being viewed based on the acquired viewing angle of eyes of the viewer. Here, the processing unit 312 can determine the area covered by the viewing angle on the screen based on the viewing angle of eyes of the viewer, and thus determine the first screen area 11. In the present embodiment, assuming that the viewing angle of the eyes of the viewer covers a rectangular panel partition (1, 1), a rectangular backlight partition (1,1), a rectangular panel partition (2, 1) and a rectangular backlight partition (2, 1), thus in the present embodiment, the first screen area 11 includes the rectangular panel partition (1, 1), the rectangular backlight partition (1,1), the rectangular panel partition (2, 1) and the rectangular backlight partition (2, 1), but the present disclosure is not limited hereto.

The first calculating unit 313 is configured to subtract the first screen area 11 by the whole screen of the liquid crystal display to calculate the second screen area 12. That is to say, the rectangular panel partitions and the rectangular backlight partitions that are not covered by the viewing angle of the eyes of the viewer are the second screen area 12, and thus in the present embodiment, the second screen area 12 includes a rectangular panel partition (3, 1), . . . , a rectangular panel partition (M, 1), and a rectangular backlight partition (3, 1), . . . , and a rectangular backlight partition (M, 1), but the present disclosure is not limited hereto.

The dynamic backlight control module 32 includes a receiving unit 321, a characteristic parameter extraction unit 322, a second calculating unit 323, a backlight adjustment unit 324 and a grayscale value compensation unit 325.

The receiving unit 321 is configured to receive externally input image data. Here, the externally input image data is provided for all the pixels in the whole liquid crystal panel 10. The image data may be RGB values input, for example.

The characteristic parameter extraction unit 322 is configured to extract a characteristic parameter of the image data corresponding to the second screen area 12 in the image data. As another embodiment of the present disclosure, the characteristic parameter extraction unit 322 can also be configured to extract a characteristic parameter of the image data (that is, the input entire image data).

The second calculating unit 323 is configured to calculate a backlight adjustment factor based on the extracted characteristic parameter.

The backlight adjustment unit 324 is configured to adjust brightness of the backlight corresponding to the second screen area 12 based on the backlight adjustment factor. Here, the backlight adjustment unit 324 can also be configured to receive a feedback signal provided by the processing unit 312, wherein the feedback signal includes a signal to not perform backlight brightness adjustment on the first screen area 11. Particularly, the backlight adjustment unit 324 adjusts a duty ratio of a PWM signal provided to a light source (e.g., an LED) of the rectangular backlight partition (3, 1), . . . , rectangular backlight partition (M, 1) of the second screen area 12 based on the backlight adjustment factor, so as to adjust and reduce the brightness of the light source, thereby realizing the brightness adjustment of the backlight corresponding to the second screen area 12.

The grayscale value compensation unit 325 is configured to compensate a grayscale value of pixels corresponding to the second screen area 12 based on the backlight adjustment factor. In specific, the grayscale value compensation unit 325 compensates a grayscale value of pixels corresponding to the rectangular panel partition (3, 1), . . . , rectangular panel partition (M, 1) of the second screen area 12 based on the backlight adjustment factor.

For example, the backlight adjustment unit 324 adjusts the light source of the rectangular backlight partition (3, 1), . . . , rectangular backlight partition (M, 1) of the second screen area 12 based on the backlight adjustment factor to reduce the brightness of the light source by 30%. Accordingly, the grayscale value compensation unit 325 compensates the grayscale value of the pixels of the rectangular panel partition (3, 1), . . . , rectangular panel partition (M, 1) of the second screen area 12 to increase the grayscale value by 30%. Thus, the brightness of the light source is reduced without changing the brightness of the display image in the second screen area, thereby reducing power consumption.

Figure 3:
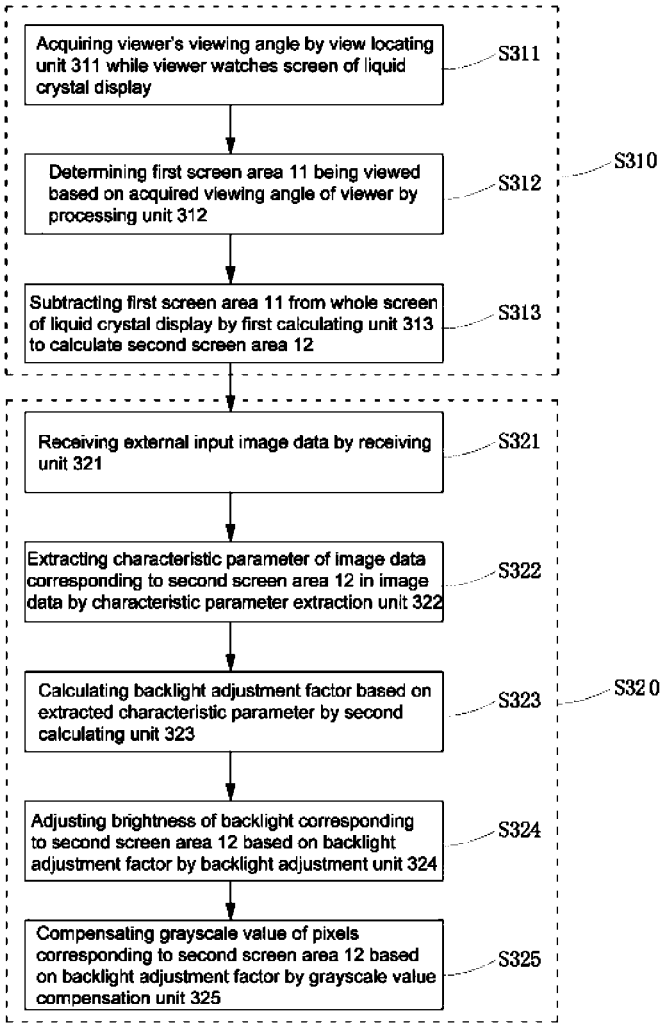
FIG. 3 is a flow diagram of a method for reducing power consumption of a liquid crystal display according to an embodiment of the present disclosure.

FIG. 3 is a flow diagram of a method for reducing power consumption of a liquid crystal display according to an embodiment of the present disclosure.

Referring to FIGS. 2 and 3, the method for reducing power consumption of the liquid crystal display according to an embodiment of the present disclosure includes Steps S310 and S320.

In specific, in Step S310, the screen area acquisition module 31 acquires a first screen area 11 being viewed by the viewer and a second screen area 12 not being viewed by the viewer.

The specific method of realizing Step S310 includes the followings.

In Step S311, the view locating unit 311 acquires a viewing angle of eyes of the viewer while the viewer watches the screen of the liquid crystal display. In addition, in Step S311, the view locating unit 311 can include a camera and a biosensor, and can acquire the viewing angle of eyes while the viewer watches the liquid crystal display through the camera and the biosensor.

In Step S312, the processing unit 312 determines the first screen area 11 being viewed based on the acquired viewing angle of eyes of the viewer. In addition, in Step S312, the processing unit 312 can determine the area covered by the viewing angle on the screen based on the viewing angle of eyes of the viewer, and thus determine the first screen area 11. Assuming that the viewing angle of the eyes of the viewer covers a rectangular panel partition (1, 1), a rectangular backlight partition (1,1), a rectangular panel partition (2, 1) and a rectangular backlight partition (2, 1), and thus in Step S312, the first screen area 11 includes the rectangular panel partition (1, 1), the rectangular backlight partition (1,1), the rectangular panel partition (2, 1) and the rectangular backlight partition (2, 1).

In Step S313, the first calculating unit 313 subtracts the first screen area 11 from the whole screen of the liquid crystal display to calculate the second screen area 12. That is to say, in Step S313, the rectangular panel partitions and the rectangular backlight partitions that are not covered by the viewing angle of eyes of the viewer are the second screen area 12, that is, the second screen area 12 includes a rectangular panel partition (3, 1), . . . , a rectangular panel partition (M, 1), and a rectangular backlight partition (3, 1), . . . , and a rectangular backlight partition (M, 1).

In Step S320, a dynamic backlight control module 32 only performs a dynamic backlight control adjustment on the second screen area 12.

The specific method of realizing Step S320 includes the followings.

In Step S321, the receiving unit 321 receives externally input image data. In addition, in Step S321, the externally input image data is provided for all the pixels in the whole liquid crystal panel 10, wherein the image data may be input RGB values, for example.

In Step S322, the characteristic parameter extraction unit 322 extracts a characteristic parameter of the image data corresponding to the second screen area 12 in the image data. As another alternative step of step S322, the characteristic parameter extraction unit 322 can also extract a characteristic parameter of the image data (that is, the input entire image data).

In Step S323, the second calculating unit 323 calculates a backlight adjustment factor based on the extracted characteristic parameter.

In Step S324, the backlight adjustment unit 324 adjusts the brightness of the backlight corresponding to the second screen area 12 based on the backlight adjustment factor. In addition, in Step S324, the backlight adjustment unit 324 can also receive a feedback signal provided by the processing unit 312 and the first calculating unit 313, wherein the feedback signal includes a signal to perform backlight brightness adjustment on the second screen area 12 and a signal to not perform backlight brightness adjustment on the first screen area 11. Further, the backlight adjustment unit 324 adjusts a duty ratio of a PWM signal provided to a light source (e.g., LED) of the rectangular backlight partition (3, 1), . . . , rectangular backlight partition (M, 1) of the second screen area 12 based on the backlight adjustment factor, so as to adjust and reduce the brightness of the light source, thereby realizing the brightness adjustment of the backlight corresponding to the second screen area 12.

In Step S325, the grayscale value compensation unit 325 compensates a grayscale value of pixels corresponding to the second screen area 12 based on the backlight adjustment factor. In addition, in Step S325, the grayscale value compensation unit 325 compensates a grayscale value of pixels corresponding to the rectangular panel partition (3, 1), . . . , rectangular panel partition (M, 1) of the second screen area 12 based on the backlight adjustment factor.

In the power consumption reduction method of the liquid crystal display according to the embodiment of the present disclosure, the backlight adjustment unit 324 adjusts the light source of the rectangular backlight partition (3, 1), . . . , rectangular backlight partition (M, 1) of the second screen area 12 based on the backlight adjustment factor to reduce the brightness of the light source by 30%. Accordingly, the grayscale value compensation unit 325 compensates the grayscale value of pixels of the rectangular panel partition (3, 1), . . . , rectangular panel partition (M, 1) of the second screen area 12 to increase the grayscale value by 30%. Thus, the brightness of the light source is reduced without changing the brightness of the display image in the second screen area, thereby reducing power consumption.

In conclusion, the device and method for reducing power consumption of the liquid crystal display according to the embodiment of the present disclosure realize intelligently partitioning dynamic backlight control to the screen of the liquid crystal display and also reduce the power consumption.

Although the present invention is described with reference to the special exemplary embodiments, while those skilled in the art will understand that various changes in form and details may be made therein without departing from the spirit and scope of the disclosure as defined by the appended claims and its equivalents.

What is claimed is:

1. A device for reducing power consumption of a liquid crystal display, comprising a memory configured to store program instructions and a processor configured to execute the program instructions, the program instructions when executed configured to:

acquire a first screen area being viewed and a second screen area not being viewed while a viewer watches a screen of the liquid crystal display;

perform a dynamic backlight control adjustment on the second screen area;

receive externally input image data;

extract a characteristic parameter of the image data corresponding to the second screen area in the image data;

calculate a backlight adjustment factor based on the extracted characteristic parameter;

adjust brightness of the backlight corresponding to the second screen area based on the backlight adjustment factor; and compensate a grayscale value of pixels corresponding to the second screen area based on the backlight adjustment factor.

2. The device of claim 1, wherein, to acquire the first screen area, the program instructions are further configured to:

acquire a viewing angle of eyes of the viewer while the viewer watches the screen of the liquid crystal display;

determine the first screen area being viewed based on the acquired viewing angle of eyes of the viewer; and subtract the first screen area from the screen of the liquid crystal display to calculate the second screen area.

3. A liquid crystal display, comprising the device of claim 1.

4. A method for reducing power consumption of a liquid crystal display, comprising:

acquiring a first screen area being viewed and a second screen area not being viewed while a viewer watches a screen of the liquid crystal display;

performing a dynamic backlight control adjustment on the second screen area;

receiving externally input image data;

extracting a characteristic parameter of the image data corresponding to the second screen area in the image data;

calculating a backlight adjustment factor based on the extracted characteristic parameter;

adjusting brightness of the backlight corresponding to the second screen area based on the backlight adjustment factor; and compensating a grayscale value of pixels corresponding to the second screen area based on the backlight adjustment factor.

5. The method of claim 4, wherein the acquiring of the first screen area being viewed and the second screen area not being viewed while the viewer watches the screen of the liquid crystal display comprises:

acquiring a viewing angle of eyes of the viewer while the viewer watches the screen of the liquid crystal display;

determining the first screen area being viewed based on the acquired viewing angle of eyes of the viewer; and subtracting the first screen area from the screen of the liquid crystal display to obtain the second screen area.

* * * * *